US005746104A

United States Patent [19]

Russell et al.

[11] Patent Number: 5,746,104

[45] Date of Patent: May 5, 1998

[54] TWO-PIECE HOLE PUNCH

[75] Inventors: Howard L. Russell; William N. Morris, Jr., both of Wilmington, N.C.

[73] Assignee: Wilmington Rubber & Gasket Co., Inc., Wilmington, N.C.

[21] Appl. No.: 702,067

[22] Filed: Aug. 23, 1996

[51] Int. Cl.[6] ..... B26D 7/26

[52] U.S. Cl. ..... 83/698.71; 83/698.91; 83/684

[58] Field of Search ..... 83/699.11, 698.91, 83/698.71, 699.31, 699.41, 699.51, 699.61, 684

[56] References Cited

U.S. PATENT DOCUMENTS

| | | | |
|---|---|---|---|
| 2,087,186 | 7/1937 | Freeman, Jr. | 83/698.91 |
| 2,379,367 | 6/1945 | Marchant . | |
| 2,598,975 | 6/1952 | Coulter | 83/698.91 |
| 3,063,319 | 11/1962 | Johnson . | |
| 3,641,860 | 2/1972 | Whistler, Sr. et al. . | |
| 4,096,776 | 6/1978 | Laucke | 83/698.91 |
| 4,257,292 | 3/1981 | Faull | 83/698.91 |
| 4,273,015 | 6/1981 | Johnson . | |
| 4,526,077 | 7/1985 | DeGuvera . | |
| 4,621,556 | 11/1986 | Soltysiak et al. . | |
| 5,005,458 | 4/1991 | Merrick . | |
| 5,044,244 | 9/1991 | Olson . | |
| 5,133,237 | 7/1992 | Daffé . | |

FOREIGN PATENT DOCUMENTS

| | | | |
|---|---|---|---|
| 2409839 | 6/1979 | France | 83/698.91 |

*Primary Examiner*—Maurina T. Rachuba

*Attorney, Agent, or Firm*—Kennedy Covington Lobdell & Hickman, LLP

[57] ABSTRACT

A two-piece punch for use in a punch press to form holes in a workpiece. The punch includes a shank portion to be retained in a punch press, a two-piece cutter element consisting of a socket member attached to the shank portion, the socket member having a socket bore with an open end, and a cutter insert for insertion in the open end of the socket bore to be seated therein, the cutter insert having a cutting end projecting outwardly from the socket member when the cutter is seated in the socket bore, and a cutting edge on the cutting end. The punch also has a retainer for retaining the cutter insert in the socket bore. The cutter insert is preferably formed of a substantially cylindrical annular member, and the cutting edge is an outer bevel formed on the outer circumference of the cutter insert at its cutting end. An inwardly extending annular shoulder at the cutting end forms a reinforced throat for the cutting edge. The socket bore preferably has a shank end which comprises an annular mounting surface having an opening of reduced diameter relative to the socket bore.

7 Claims, 2 Drawing Sheets

TWO-PIECE HOLE PUNCH

BACKGROUND OF THE INVENTION

The present invention relates generally to punches for forming holes in workpieces and, more particularly, to a two-piece punch with a replaceable insert for use in an arch press.

Punches are commonly used in arch presses to form holes in materials such as cork, rubber, cloth-impregnated rubber, compressed fiberboard, carbon sheet, and leather for the purpose of manufacturing industrial gaskets and other like items. Such arch presses typically use a one-piece punch consisting of a shank which is retained in the arch press and an integral cutter head for contacting the workpiece to be punched.

As a result of the high operating pressures used in arch presses, the cutter heads are easily damaged in use, requiring replacement of the entire one-piece punch. Use of a punch also causes its cutting edge to become dull, necessitating either replacement of the entire one-piece punch or resharpening of the cutting edge. Resharpening, however, is difficult, and even when successful, has an inherent disadvantage in that it changes the diameter of the holes produced by the punch. Moreover, the shape of the cutting head on one-piece punches, which typically consists of a conical profile tapering evenly to the tip of the cutting head, produces a thin cutting edge which can wear unevenly and damage the workpiece. Additionally, it is sometimes desirable to form in the workpiece a hole having straight side walls, and such a hole can only be formed by a punch having a non-conical outer circumference. Such a configuration is difficult to produce in a typical one-piece punch.

The present invention provides a two-piece punch which avoids or alleviates the aforesaid drawbacks of conventional one-piece punches.

SUMMARY OF THE INVENTION

In accordance with the present invention, a punch is provided for use in a punch press to perforate a workpiece while allowing quick replacement of a cutting insert for the punch. The device of the present invention comprises a shank portion to be retained in a punch press, a two-piece cutter element which consists of a socket member attached to the shank member and having a socket bore with an open end, and a cutter insert which is dimensioned to be received in the open end of the socket bore for seating in the bore, the cutter insert having a cutting end which projects outwardly from the socket member when the cutter insert is seated in the bore, and a cutting edge formed on the cutting end. The punch has a retainer for selectively retaining the cutter insert in the socket bore in its seated disposition.

It is preferred that the cutter insert be substantially cylindrical and annular and that the cutting edge is an outer bevel formed on the outer annular circumference of the cutter insert at the cutting end. The cutting edge may also include an inner cleaving edge and the inner cleaving edge may be substantially smaller than the outer bevel. The cutter insert may have an inwardly extending annular shoulder at the cutting end to form a reinforced throat for the cutting edge.

The cutting edge may also advantageously be an inner bevel formed on the inner annular circumference of the cutter insert at the cutting end and may include an outer cleaving edge with the inner bevel. The outer cleaving edge may be substantially smaller than the inner bevel.

Accordingly, the present invention provides a two-piece punch which has a cutter insert capable of being released and exchanged when a new cutter insert is desired. Moreover, the present invention allows the cutting edge of the cutter insert to be formed as either an outer bevel or an inner bevel, and further provides for a reinforced throat to support the cutting edge.

DESCRIPTION OF THE PREFERRED EMBODIMENT

Figure 1:
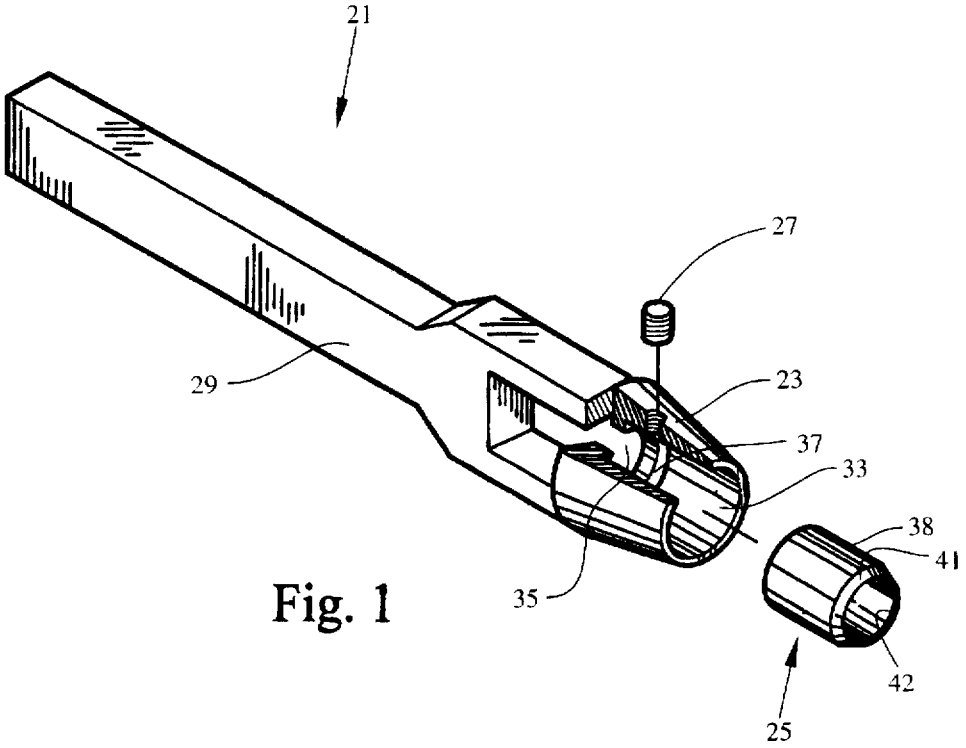
FIG. 1 is a perspective view of a two-piece punch embodying the present invention, with a portion of the socket member broken away.

Looking now in greater detail at the accompanying drawings, FIG. 1 illustrates in perspective view the two-piece punch 21 of the present invention with a socket member 23 shown partially in section and a cutter insert 25 positioned to be inserted in the socket member 23 and secured by a set screw 27. The punch 21 of FIG. 1 also includes a shank portion 29 configured to be inserted in a conventional arch press (not shown) and retained therein for punching operations.

The socket member 23 is preferably fixed to shank portion 29 and includes a socket bore 33 having an opening and formed to receive cutter insert 25 therein. The socket bore 33 also has a shank end 35 having an opening which has a diameter of reduced dimension relative to the socket bore 33 so as to form an annular mounting surface 37, which abuts cutter insert 25 when it is in its seated disposition.

Figure 2:
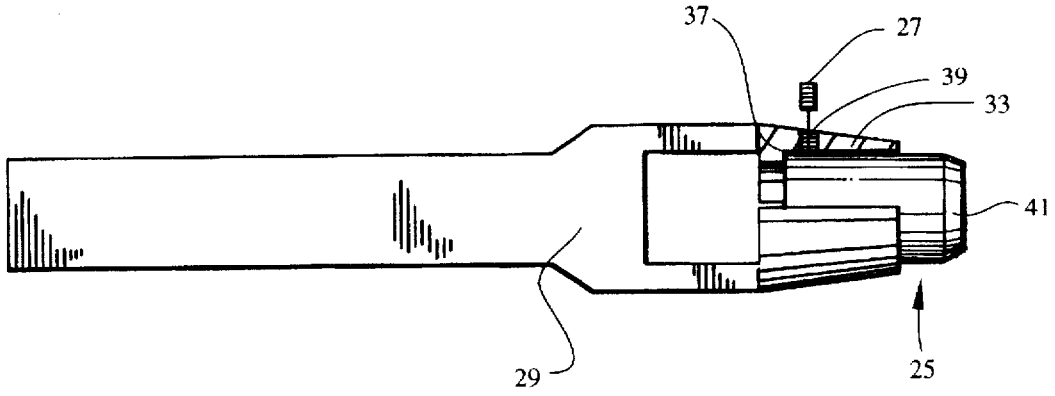
FIG. 2 is an elevational view of the device of FIG. 1.

The cutter insert 25, when mounted in the socket bore 33, abuts mounting surface 37, as shown in FIG. 2. Cutter insert 25 is secured in socket bore 33 by threaded engagement of set screw 27 in threaded bore 39 so as to retain the cutter insert 25.

Figure 3:
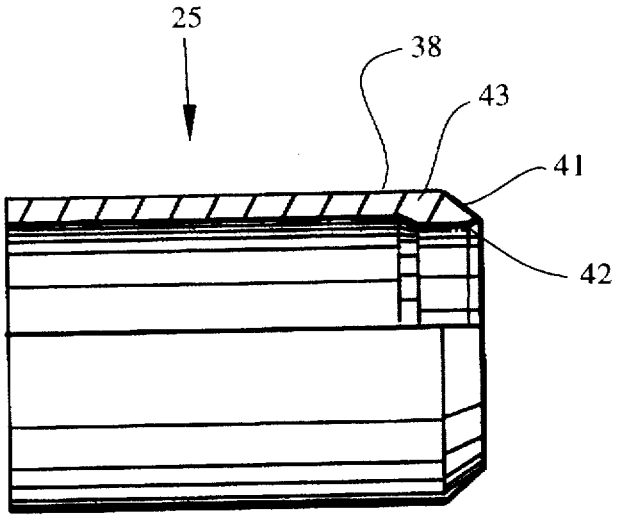
FIG. 3 is an elevational view of one embodiment of the cutter insert of the present invention, with a portion of the cutter insert broken away to show the interior of the insert.

The cutter insert 25 has a cutting end 38 and a cutting edge thereon formed by an outer bevel 41 and an inner cleaving edge 42. It is advantageous if inner cleaving edge 42 is substantially smaller than outer bevel 41. As seen in FIGS. 2 and 3, the cutter insert 25 is preferably substantially cylindrical and annular and is preferably dimensioned to be received in the socket bore 33. In one embodiment of the present invention, the cutter insert 25 has an inwardly extending annular shoulder at the cutting forming a reinforced throat 43 (see FIG. 3), which provides additional strength to the cutting end of the cutting insert 25.

Figure 4:
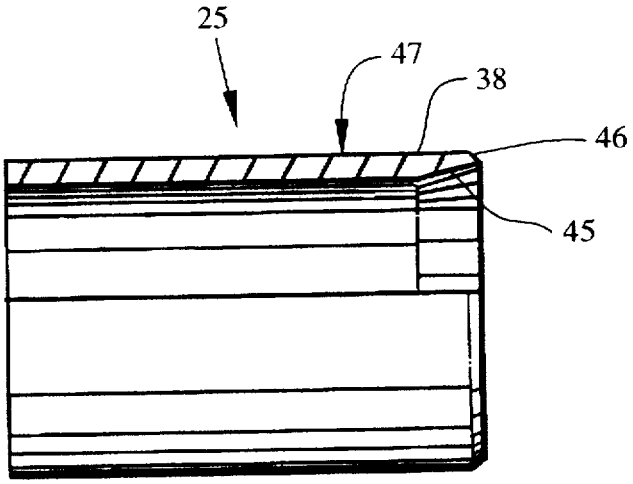
FIG. 4 is an elevational view of another embodiment of the cutter insert of the present invention, with a portion of the cutter insert broken away to show the interior of the insert.

In another embodiment of the present invention, as shown in FIG. 4, an inner bevel 45 is formed at the cutting end of the cutter insert 25 along with an outer cleaving edge 46, which allows the outer side wall 47 of the cutter insert 25 to remain substantially straight and to extend essentially in a direction parallel to the longitudinal axis of the cutter insert 25 with only outer cleaving edge 46 extending inwardly. Outer cleaving edge 46 is substantially smaller than inner bevel 45, which allows a stable cutting edge to be formed without substantially altering the profile of sidewall 47.

In use, the two-piece punch of the present invention is mounted in an arch press positioned above a workpiece in which holes are to be formed, as is conventional. Typically, the workpiece consists of a material such as cork, rubber, cloth-impregnated rubber, compressed fiberboard, carbon sheet, leather, or the like in which holes are to be formed for the purpose of producing items such as industrial gaskets, although arch presses may be used on other materials for the purpose of producing other types of items as well.

The punch of the present invention would typically be mounted and used in an arch press in a conventional manner. However, the two-piece punch of the present invention allows the cutter insert 25 to be quickly and easily replaced once the cutting edge of the punch becomes dull or damaged or when a differing cutting profile is desired. Replacement of the cutter insert 25 is accomplished by merely loosening set screw 27, removing the wornout cutter insert, inserting a new cutter insert 25 in socket bore 33 so that it is seated against annular mounting surface 37 and retightening the set screw 27 to secure the cutter insert in place.

By replacing only the cutter insert 25, the shank portion 29 and the socket member 23 can be retained and kept in service, resulting in a greater useful life for these items. Replacement of the cutter insert 25 therefore allows the user to avoid discarding the entire punch, while providing an efficient and cost-effective way to bring a sharpened and undamaged cutting edge into use. The user can also avoid the difficult task of attempting to resharpen a one-piece punch which, when successful, ordinarily has the detrimental effect of increasing the diameter of the hole cut by the resharpened punch. Instead, the present invention permits a worn cutter insert 25 to be selectively released from the second bore 33 and quickly replaced by a new cutter insert.

The cutter insert 25 of the present invention also allows the use of a beveled edge and a cleaving edge, which in one embodiment is an outer bevel 41 and an inner cleaving edge 42, as shown in FIG. 3. The use of a beveled edge results in the punch of the present invention forming more regularly shaped holes and causing less damage to the workpiece being cut. Moreover, the beveled edge wears more evenly and, in many circumstances, has a greater useful life. The reinforced throat 43 of the present invention also provides additional stability and rigidity to the bevel 41 forming the cutting edge, which likewise increases the service life and cutting capacity of the cutter insert 25. The reinforced throat 43 further allows punch 21 to be reliably used at greater operating pressures.

The inner bevel 45 in another embodiment of the present invention permits punch 21 to be used to produce holes having straight sides, since the use of the inner bevel 45 and an outer cleaving edge 46 allows the outer surface of the cutter insert 25 to extend substantially parallel to the cutter insert's longitudinal axis, with only outer cleaving edge 46 on the outer surface 47. A cutter insert with an inside bevel 45 can be easily exchanged with a cutting insert having a outer bevel 41, as previously explained above.

The two-piece punch of the present invention thus has several advantages over previous punches. A conventional cutter insert the present invention can, once it becomes worn, be selectively released for replacement with a new cutter insert. The shank portion and socket member of the present invention, however, remain in use as the cutter inserts are replaced, providing an efficient and economical way to maintain sharp cutting edges on the punch. The cutter insert of the present invention permits the use of a bevel to form the cutting edge of the insert, which produces a longer-wearing, more accurate, and more stable edge. In one embodiment, the present invention includes a reinforced throat which adds further stability and strength to the cutting edge. The bevel forming the cutting edge can be located as an outer bevel or, in one embodiment, as an inner bevel, allowing the present invention to produce holes with straight sides.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A punch for use in a punch press to perforate a workpiece, comprising:

a shank portion for retaining engagement in said punch press;

a two-piece cutter element including a socket member attached to said shank portion, said socket member having a socket bore with an open end, and a substantially cylindrical annular cutter insert dimensioned to be received in said bore and for seated disposition in said bore;

said cutter insert having a cutting end projecting outwardly from said socket member when said cutter insert is in its seated disposition, a cutting edge formed on said cutting end including an outer bevel formed on the outer annular circumference of said cutter insert, and an inwardly extending annular shoulder at said cutting end to form a reinforced throat for said cutting edge; and selectively releasable retaining means for retaining said cutter insert in said socket bore in said seated disposition.

2. A punch for use in a punch press to perforate a workpiece, comprising:

a shank portion for retaining engagement in said punch press;

a two-piece cutter element including a socket member attached to said shank portion, said socket member having a socket bore with an open end, and a substantially cylindrical annular cutter insert dimensioned to be received in said bore and for seated disposition in said bore;

said cutter insert having a cutting end projecting outwardly from said socket member when said cutter insert is in its seated disposition, and a cutting edge formed on said cutting end;

said cutting edge including an outer bevel formed on the outer annular circumference of said cutter insert at said cutting end, and an inner cleaving edge formed on the inner annular circumference of said cutter insert at said cutting end; and selectively releasable retaining means for retaining said cutter insert in said socket bore in said seated disposition.

3. The punch of claim 2, wherein said inner cleaving edge is substantially smaller than said outer bevel.

4. The punch of claim 1, wherein said cutting edge comprises an inner bevel formed on the inner annular circumference of said cutter insert at said cutting end.

5. The punch of claim 4, wherein said cutting edge further comprises an inner cleaving edge.

6. The punch of claim 5, wherein said outer cleaving edge is substantially smaller than said inner bevel.

7. A punch for use in a punch press to perforate a workpiece, comprising:

a shank portion for retaining engagement in said punch press;

a two-piece cutter element including a socket member attached to said shank portion, said socket member having a socket bore with an open end, and a substantially cylindrical annular cutter insert dimensioned to be received in said bore and for seated disposition in said bore;

said bore including a shank end comprising an annular mounting surface having an opening of reduced diameter relative to said bore, said mounting surface abutting said cutter insert when said cutter insert is in its seated disposition;

said cutter insert having a cutting end projecting outwardly from said socket member when said cutter insert is in its seated disposition, a cutting edge formed on said cutting end, and an inwardly extending annular shoulder at said cutting end to form a reinforced throat for said cutting edge;

said cutting edge including an outer bevel formed on the outer annular circumference of said cutter insert at said cutting end, and an inner cleaving edge formed on the inner annular circumference of said cutter element at said cutting end; and a set screw threadedly mounted in said socket member to extend into selectively releasable locking engagement with said cutter insert.

* * * * *